US005707724A

United States Patent [19]

Russell

[11] Patent Number: 5,707,724

[45] Date of Patent: Jan. 13, 1998

[54] FRACTAL TUBE REINFORCEMENT

[75] Inventor: Daniel N. Russell, Tampa, Fla.

[73] Assignee: Lundin Marine, Inc., Baton Rouge, La.

[21] Appl. No.: 744,059

[22] Filed: Nov. 8, 1996

[51] Int. Cl.[6] ..... B63B 35/613; B32B 5/20

[52] U.S. Cl. ..... 428/318.8; 428/317.9; 428/318.6; 428/34.5; 441/44; 441/45; 441/136

[58] Field of Search ..... 428/34.5, 317.9, 428/318.6, 318.8; 441/44, 45, 136

[56] References Cited

U.S. PATENT DOCUMENTS 5,134,003 7/1992 Hackenberg ..... 428/36.3

*Primary Examiner*—Richard Weisberger

[57] ABSTRACT

Fractal hollow tube reinforced structural members are presented having a maximum strength-to-weight ratio and a wall density less than ½ that of water, which are versatile, practical and economical for use in any kind of construction. The strength is maximized by introducing a high degree of order down to the atomic scale to the walls of the hollow structures, while the mass and thickness of these walls is minimized. The wall density is further reduced by including microspheres in the walls, mesh spaces and bonding substances which minimizes the total mass of bonding agent that uselessly occupies the dead spaces of the meshes and coils of the fibers and tubes. Strength and thermal tolerance are further enhanced by building the tube walls out of hollow carbon or titanium fibers and buckyball microspheres. These fractal structural members will greatly improve the fuel efficiency of any craft supported by them and will make possible crafts and structures never possible before.

20 Claims, 1 Drawing Sheet

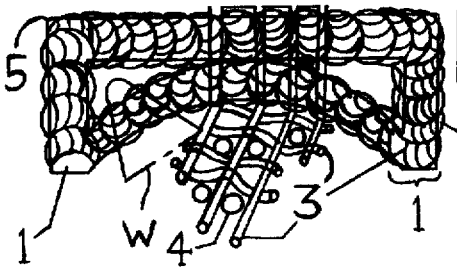
FIG.1A
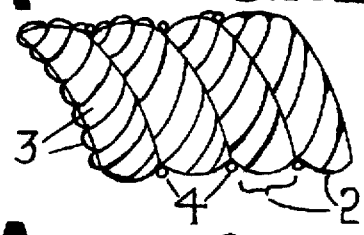
FIG.1B
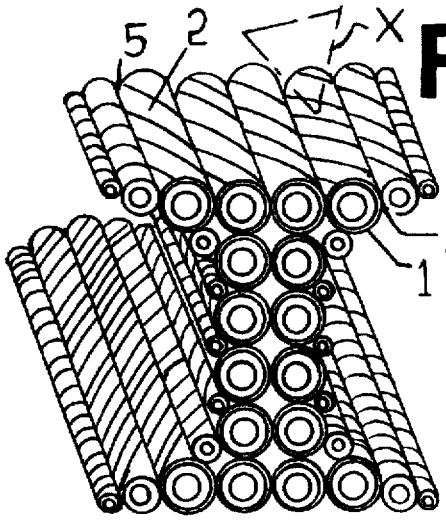
FIG.2A
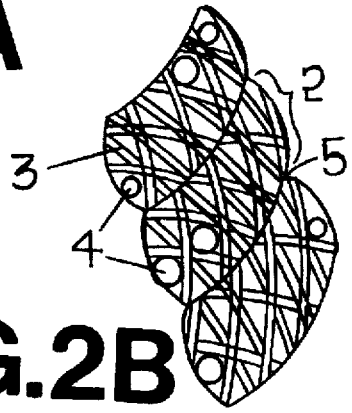
FIG.2B
FIG 3A
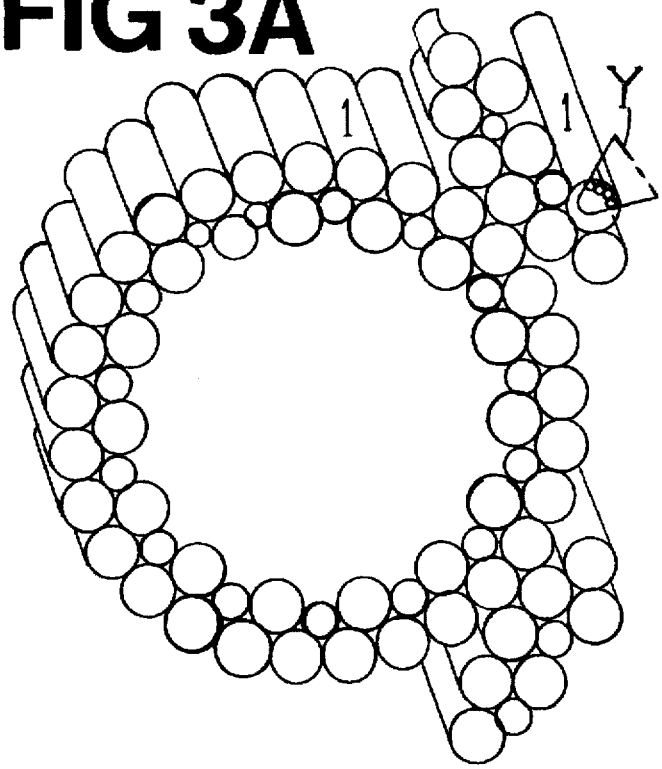
FIG.3B
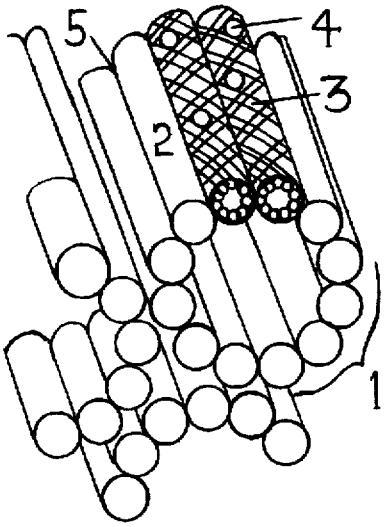

FRACTAL TUBE REINFORCEMENT

BACKGROUND

The present invention relates to hollow tube reinforced hollow cylindrical structural support members having wall density less than half the density of water, and having a maximum strength-to-weight ratio.

It is well known that the atomic and molecular kinetic compression resistance energy is inversely proportional to both the mass and the square of the size of the electron domain according to:

$$E=\frac{3\,h^2}{8\,ml^2},$$

where E is the energy, or strength, which resists compression, h is Plank's constant, m is the mass, and l is the size. This equation shows that size and mass can be minimized in order to obtain a maximum strength, and that, fundamentally, it is the level of organization that yields strength, rather than size and weight. The discovery that the carbon compound known by the trademark, "Kevlar®," is much stronger than steel even though the carbon atom is 4.65 times lighter and a lot smaller than the iron atom certainly proves this to be true. The fact that carbon fibers have a much higher strength than fiberglass, even though the $SiO_2$ molecule of fiberglass is 5 times beaver and a lot bigger than carbon, is further proof that this is true, because carbon fibers have a higher level of order than steel or fiberglass.

Noland et. al. disclose in U.S. Pat. No. 5,338,605 hollow, non-porous carbon fibers and woven fabrics that have higher strength-to-weight ratio than that of solid carbon fibers and fabrics. Bethune et. al. disclose in U.S. Pat. No. 5,424,054 hollow carbon fibers having a cylindrical wall only one atom layer thick and measured to be 12 Angstroms thick. However, neither of these have been used to produce higher ordered fractal hollow tube reinforced structural members, which are less than half the density of water. Both Stockwell in U.S. Pat. No. 5,359,735 and Kölzer in U.S. Pat. No. 5,292,578 disclose using hollow microspheres to increase the insulative properties of woven fabric. However, these relate to filtration systems and do not teach any increase in the strength to weight ratio of fractal tube reinforced structural members. Hackenberg discloses in U.S. Pat. No. 5,134,003 a hollow cylindrical structural member constructed of helically wound solid carbon fibers that are resin bonded for use in the prevention of layer separation in high speed rotors. However, fractal hollow tubes of hollow fibers are not used to build the walls of the cylinder, and hollow tubes and microspheres are not used here at all. Therefore, the prior art does not even attempt fractal tube reinforced hollow cylinder construction of structural members. The prior art also does not show or teach the construction of structural members that are less dense than water with a high strength-to-weight ratio.

So, there remains a need to provide a structural support member for the construction industry that is less dense than water and light in weight with a maximum strength-to-weight ratio to enable the construction of all kinds of products that are both stronger and lighter, more cost efficient, more fuel efficient, and with superior thermal tolerance.

SUMMARY

An object of the present invention is to provide a versatile, economical, practical structural member for the construction industry having a density less than half of the density of water with a maximum strength-to-weight ratio and with superior thermal tolerance. Another object is to minimize the cost as well as the mass of structural reinforcement members while maximizing their strength. It is a further object to provide a very efficient way to recycle plastic into low cost, light weight, strong structural members that are useful in construction.

These and other objects are Achieved according to the present invention by a fractal hollow tube reinforced structural support member which is constructed from hollow cylinders, which are made out of hollow tubes, which are built out of hollow fibers. The walls of these cylinders are less than half the density of water and are very highly ordered arrangements of hollow tubes. The hollow tubes are, optimally, constructed of very strong and very light fibers such as hollow carbon. The walls of these hollow tubes are, optimally, less than half the density of water. The tubes and cylinders contain hollow microspheres in the spaces between the fibers and tubes. The microspheres are also contained in the bonding substance that is used to set and hold the high level of order, and their purpose is to minimize excess bonding agent. The purpose of using hollow fibers is to achieve a highly ordered state down to the atomic scale, so that the mass and thickness can be minimized while maximizing strength. The fractal nature of this construction of hollow structures increases the thermal tolerance and insulative value, and multiplies the improvement in strength per weight.

Other objects, aspects and advantages will become apparent from the following drawings taken in conjunction with the detailed description.

BRIEF DESCRIPTION OF DRAWINGS

FIG. 1A is a side view of a beam constructed from a stack of hollow cylinders made out of coiled hollow tubes formed from hollow fibers.

FIG. 1B is an enlarged view of section W of FIG. 1A.

FIG. 2A is a 20° off center perspective view of an I-beam constructed from stacked hollow cylinders made of mesh cloth tubes formed from fibers.

FIG. 2B is an enlarged view of section X of FIG. 2A.

FIG. 3A is a 20° off center perspective view of a group of columns formed from cylindrically stacked hollow cylinders made of crossing helically coiled tubes which are formed from a network of fibers.

FIG. 3B is an enlarged view of section Y of FIG. 3A.

DESCRIPTION OF PREFERRED EMBODIMENTS

The present invention is a fractal tube reinforcement of very high strength-to-weight ratio structural support members that are less than one half of the density of water for use principally in construction. In the embodiments described below the structural members of FIGS. 1*a*, 2*a*, and 3*a* are built of hollow cylinders 1. The walls of the hollow cylinders are built out of hollow tubes 2, and the walls of the tubes are, optimally, built from hollow fibers 3. The fractal nature of the hollow tubular construction allows the minimization of both mass and wall thickness down to the atomic scale and the maximization of both order and strength. In this way a maximum strength-to-weight ratio is obtained with a minimum density and materials cost. This is an application of the equation stated hereinabove in the "Background" relating the strength, or energy, resisting compression to mass and size of an atom, $E=3h^2/8ml^2$, where E is the energy resisting compression, h is Plank's constant, m is mass, and l is the diameter.

The cylinders 1 have a wall density of less than one half gram per cubic centimeter and the tubes 2 have a wall density of less than one gram per cubic centimeter. The inside diameter of the tubes 2 is at least 30% and, optimally, 50% of their outside diameter. The fibers 3 may be solid, but are, optimally, hollow with an optimum fiber wall thickness of one atomic layer, which measures less than 20 Angstroms. The inclusion of microspheres 4 eliminates excess bonding substance 5 that would otherwise occupy dead spaces between fibers 3 and between tubes 2. The microspheres 4 are made from a material selected from glass, plastic, metal, and $C_{60}$ buckyballs. The bonding substance 5 is applied at a temperature of at most the melting temperature of the fibers 3. The bonding substance 5 contains at least 6% microspheres 4 by volume.

A ship hull and deck support bulkhead member is shown in FIGS. 1A and 2A. It is built from a stack of bonded hollow cylinders 1. The walls of the hollow cylinders 1 are built by helically coiling tubes 2. In a first embodiment Fibers 3 are coiled to form the walls of the tubes 2. In a second embodiment the fibers 3 are formed into a mesh cloth that is rolled to form the tubes 2. An enlarged view of the tube 2 structure of section W of FIG. 1A is shown in FIG. 1B which shows the structure of the first embodiment, and in FIG. 2B which shows the structure of the second embodiment, section X of FIG. 1A. To save cost the fibers 3 are fiberglass and aluminium and the bonding substance 5 is a material selected from polyester resin and urethane glue. To maximize strength the fibers 3 are hollow or solid carbon bonded with epoxy resin.

An I-beam support member for heavy construction shown in FIG. 2A is another example of fractal tube reinforcement. It consists of a bonded stack of hollow cylinders 1 having walls made from tubes 2. The hollow tubes 2 have walls that are built from fibers 3 that are formed into a mesh cloth and rolled in the form of the tubes 2. FIG. 2B is an enlarged view of the crossing mesh tubes 2 of section X of FIG. 2A. Optimally, the fibers 3 are fine titanium woven into a mesh cloth and the bonding substance 5 is molten high strength steel. Alternatively, the fiber 3 is carbon and the bonding substance 5 is epoxy resin. In another alternative, the fiber 3 is a mixture of some titanium and some carbon fibers that are hollow and woven together to form a mesh cloth. The cloth is rolled and bonded to form the tubes 2, and the bonding substance is a material selected from molten aluminium and a high strength resin.

A group of columns is shown in FIG. 3A and is another example of fractal tube reinforcement of heavy duty structural support members. It consists of cylindrically stacked, bonded hollow cylinders 1 having walls made of hollow tubes 2. The walls of the hollow tubes 2 are built of, optimally, hollow fibers 3. FIG. 3B is an enlarged view of the tubes 2 of section Y of FIG. 3A. The tubes 2, shown in FIG. 3B, are formed by coiling fibers 3 in opposite directions so that one layer crosses the next. Hollow microspheres 4 are included to fill dead spaces. The fibers 3 are optimally made of carbon, principally, and the bonding substance 5 is a high strength resin. To save cost, alternatively, the fibers 3 are a combination of aluminum and a high strength polymer hydrocarbon such as polyethelene, and the bonding substance 5 is polyester resin. The microspheres are glass and plastic. To make steel columns, the fibers 3 are titanium and the bonding substance 5 is high strength molten steel. To make cement columns, the fibers 3 are a combination of ceramic, fiberglass and iron alloyed with cobalt and the bonding substance is cement.

In order to support a surface such as a floor or deck any of the above cylinders 1 are placed in parallel rows and overlapped with the mesh of fibers 3 and bonded to the surface together with the mesh of fibers 3 by the bonding substance 5. A mesh cloth of tubes 2 is used in place of the mesh of fibers 3 as a bonding reinforcement means for larger scale structural support. For even larger scale work such as supporting the hull of a ship, a number of the bulkhead members described in FIG. 1A are placed in parallel rows on the inside of the hull and overlaid by a mesh cloth of hollow tubes 2 and by a mesh cloth of fibers 3 and bonded together with these cloths to the hull by the bonding substance 5.

The fibers 3 are not limited to those discussed above, but may be made from any material or combination of materials. The bonding substance 5 is not limited to those discussed above, but may be made from any suitable material depending on which type of fiber 3 is chosen. The fibers 3 may be welded as a means of bonding to form the tubes 2.

The inventive combination of novel features provides structural members with a vastly increased strength-to-weight ratio over non-fractal tube structural members of the prior art. This results in important fuel savings both in the manufacturing steps, and to any type of craft or vehicles which are supported by the structural members of the present invention. The cost of materials is reduced because the mass of starting materials required to make the inventive fractal tube reinforced structural members is vastly reduced over that required in non-fractal tube constructions of the prior art. Accordingly, for all these reasons set forth, it is seen that the fractal tube reinforced structural members of the present invention represent a significant advancement in the art of construction structural members and has substantial commercial merit.

While there is shown and described herein certain specific structure embodying the invention, it will be manifest to those skilled in the art that modifications may be made without departing from the spirit and scope of the underlying inventive concept. The present invention shall not be limited to the particular forms herein shown and decsribed, except by the scope of the appended claims.

What is claimed is:

1. A fractal tube reinforced structural member consisting of: hollow cylinders being formed from hollow tubes, said tubes being formed from fibers, said cylinders, tubes, and fibers being bonded by a bonding substance at a temperature at most the melting temperature of said fibers, said cylinders having a wall density less than ½ gram per cubic centimeter, said tubes having a wall density less than 1 gram per cubic centimeter, said tubes having an inside diameter at least 30 percent of their outside diameter, and microspheres being in the spaces between said fibers and between said tubes, said microspheres being hollow.

2. The member according to claim 1, wherein said fibers are made of a material selected from polymeric hydrocarbon, carbon, ceramic, fiberglass, aluminum, titanium, and metal, and said bonding substance is made of a material selected from resin, glue, molten metal, carbon, ceramic, and recycled plastic.

3. The member according to claim 2, wherein said fibers are hollow fibers having a fiber wall thickness less than 20 microns.

4. The member according to claim 3, wherein said hollow fibers form a mesh cloth, the spaces of said mesh cloth are impregnated with said hollow microspheres, and said cloth is rolled to form said hollow tubes.

5. The member according to claim 4, wherein said hollow cylinders are stacked transverse to their long axis and bonded by said bonding substance such that they form a beam.

6. The member according to claim 4, wherein said hollow cylinders are stacked transverse to their long axis cylindrically and bonded by said bonding substance such that they form a column.

7. The member according to claim 3, wherein said fibers are hollow woven to form said hollow tubes, said tubes are coiled to form said hollow cylinders, and the tube wall density is less than 0.8 gram per cubic centimeter.

8. The member according to claim 4, wherein said hollow cylinders are disposed on a surface and overlaid with said cloth and bonded together with said cloth to said surface by said bonding substance to structurally support said surface.

9. The member according to claim 4, wherein said fibers are carbon fibers, said fiber wall thickness is less than 20 Angstroms, said microspheres are $C_{60}$ buckyballs, the tube wall density is less than ½ gram per cubic centimeter, and said bonding substance contains at least 6 percent by volume of said microspheres.

10. A fractal tube reinforced structural member consisting of: hollow cylinders built out of hollow tubes, said tubes being built from hollow fibers, said fibers having fiber wall thickness less than 20 microns, said tubes having tube wall density less than 0.9 gram per cubic centimeter, said fibers, tubes and cylinders being bonded by a bonding substance at a temperature of at most the melting temperature of said fibers, said cylinders having cylinder wall density less than ½ gram per cubic centimeter, and said tubes having an inner diameter at least 30 percent of the outer diameter of said tubes.

11. The member according to claim 10, wherein said tubes and said cylinders contain hollow microspheres in the spaces between said fibers, said bonding substance is made of a substance selected from resin, glue, molten metal, cement, ceramic, carbon, and recycled plastic, and said fibers are made from a material selected from fiberglass, cellulose, ceramic, carbon, polymeric hydrocarbon, aluminum, titanium, and metal.

12. The member according to claim 11, wherein said fibers are woven in the form of a mesh cloth, and said cloth is formed and bonded by said bonding substance into the form of said hollow tubes, and said bonding substance contains said hollow microspheres.

13. The member according to claim 12, wherein said cylinders are laid on a surface so that they are parallel to each other and overlaid by said mesh cloth and bonded together with said cloth by said bonding substance to reinforce and support said surface.

14. The member according to claim 11, wherein said cylinders are stacked transverse to their long axis and bonded by said bonding substance in the form of a beam.

15. The member according to claim 11, wherein said cylinders are cylindrically stacked transverse to their long axis and bonded by said bonding substance to form a column.

16. The member according to claim 14, wherein said beam is placed in contact with a surface and overlaid by said mesh cloth and bonded together with said cloth and said surface by said bonding substance to support said surface.

17. The member according to claim 12, wherein said hollow fibers are made of carbon having wall thickness less than 20 Angstroms, the tube walls have a density less than ½ gram per cubic centimeter, and said bonding substance contains at least 10 percent microspheres by volume.

18. The member according to claim 12, wherein said microspheres are $C_{60}$ buckyballs, and said hollow fibers are made of carbon having wall thickness of one atomic layer.

19. The member according to claim 10, wherein said fibers are coiled and welded in the configuration of said tubes, and said tubes are coiled and welded in the form of said cylinders.

20. The member according to claim 12, wherein said cloth is welded in the form of said tubes, and said tubes are welded in the form of said cylinders.

* * * * *